US009470451B2

(12) United States Patent
Kim et al.

(10) Patent No.: US 9,470,451 B2
(45) Date of Patent: Oct. 18, 2016

(54) METHOD FOR CONTROLLING OPERATION OF REFRIGERATOR

(75) Inventors: Jindong Kim, Seoul (KR); Myoungju Kang, Seoul (KR); Hosan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 554 days.

(21) Appl. No.: 13/814,684

(22) PCT Filed: Jul. 22, 2011

(86) PCT No.: PCT/KR2011/005454

§ 371 (c)(1),
(2), (4) Date: Mar. 14, 2013

(87) PCT Pub. No.: WO2012/018189

PCT Pub. Date: Feb. 9, 2012

(65) Prior Publication Data

US 2013/0167565 A1 Jul. 4, 2013

(30) Foreign Application Priority Data

Aug. 6, 2010 (KR) ..... 10-2010-0076014

(51) Int. Cl.
*F25B 49/00* (2006.01)
*F25D 29/00* (2006.01)

(52) U.S. Cl.
CPC ..... *F25D 29/00* (2013.01); *F25B 2500/12* (2013.01); *F25B 2700/172* (2013.01); *F25B 2700/173* (2013.01); *F25D 2700/02* (2013.01); *F25D 2700/10* (2013.01); *F25D 2700/12* (2013.01)

(58) Field of Classification Search
CPC ..... F25D 29/00; F25D 2700/12; F25D 2700/02; F25D 2700/10; F25B 2500/12; F25B 2700/173; F25B 2700/172
See application file for complete search history.

(56) References Cited

U.S. PATENT DOCUMENTS

| | | | | |
|---|---|---|---|---|
| 3,364,692 | A * | 1/1968 | Reynolds | 62/184 |
| 5,263,332 | A * | 11/1993 | Park | 62/157 |
| 6,494,381 | B2 * | 12/2002 | Bulthuis | H05K 7/20209 181/141 |
| 2002/0037240 | A1 * | 3/2002 | Okada et al. | 422/124 |
| 2004/0255603 | A1 * | 12/2004 | Gopalnarayanan et al. | 62/186 |
| 2005/0039469 | A1 * | 2/2005 | Nonaka | F25B 49/025 62/129 |
| 2005/0223725 | A1 * | 10/2005 | Crane et al. | 62/183 |
| 2008/0093132 | A1 * | 4/2008 | Wijaya et al. | 180/53.8 |
| 2009/0114309 | A1 * | 5/2009 | Sakai | F25B 45/00 141/1 |
| 2009/0301115 | A1 * | 12/2009 | Sugimoto et al. | 62/186 |

FOREIGN PATENT DOCUMENTS

| | | | |
|---|---|---|---|
| CN | 1199850 | A | 11/1998 |
| CN | 1357737 | A | 7/2002 |

(Continued)

OTHER PUBLICATIONS

Akira, Refrigerator, Nov. 29, 2007, JP2007309530A, Whole Document.*

*Primary Examiner* — M. Alexandra Elve
*Assistant Examiner* — Larry Furdge
(74) *Attorney, Agent, or Firm* — Birch, Stewart, Kolasch & Birch, LLP

(57) ABSTRACT

Provided is a method for controlling an operation of a refrigerator. Different operation modes are selected according to whether a refrigerator door is opened and closed, and according to an inner temperature and an ambient noise. Freezing capacity of a compressor, the number of rotations of an evaporator fan, and the number of rotations of a condenser fan are varied in conjunction with one another, to reduce a noise.

5 Claims, 3 Drawing Sheets

(56) References Cited

FOREIGN PATENT DOCUMENTS

| | | | | |
|---|---|---|---|---|
| CN | 1548894 | A | | 11/2004 |
| JP | 11-30468 | A | | 2/1999 |
| JP | 11-201608 | A | | 7/1999 |
| JP | 2007309530 | A | * | 11/2007 |
| KR | 10-2005-0117933 | A | | 12/2005 |
| KR | 10-2006-0123925 | A | | 12/2006 |
| KR | 10-0677879 | B1 | | 2/2007 |
| KR | 100705767 | B1 | | 4/2007 |
| KR | 10-2010-0022862 | A | | 3/2010 |

* cited by examiner

METHOD FOR CONTROLLING OPERATION OF REFRIGERATOR

TECHNICAL FIELD

The present disclosure relates to a method for controlling an operation of a refrigerator.

BACKGROUND ART

Recently, as concerns for the environment are gradually rising, needs for low noise refrigerators are increasing. To this end, a noise level of a refrigerator may be reduced, or freezing capacity of a refrigerator may be adjusted according to whether the refrigerator operates in the daytime or the nighttime.

Refrigerators including a linear compressor as a type of reciprocating compressor are recently commercialized. Such a linear compressor applied to refrigerators is controlled to operate according to loads by varying only a stroke of the compressor without varying a frequency thereof. Since the frequency is an important factor, the frequency is determined based on mechanical characteristics such as the characteristics of a spring disposed in the compressor, required freezing capacity, optimized efficiency, and noise characteristics.

Since a linear compressor has optimal efficiency at a resonant frequency, its operation frequency is controlled to correspond to the resonant frequency. A stroke of a piston of the compressor is increased with the operation frequency approaching the resonant frequency, so that a flow rate of refrigerant is adjusted to match with freezing capacity corresponding to a load to the refrigerator.

The resonant frequency is determined by a modulus of elasticity of a mechanical spring in the compressor; a modulus of elasticity of an injected gas spring; and the mass of both the linearly reciprocating piston and a member connected to the piston. The refrigerant in a compressed space uses its own elastic force to function as the gas spring, thereby elastically supporting the piston.

In general, when a compressor is manufactured, its resonant frequency, that is, a frequency having the maximum efficiency is determined. In addition, a frequency having the optimal noise level is determined. Furthermore, each of the resonant frequency and the frequency having the optimal noise level may be determined in plurality.

To satisfy consumers with respect to a noise from a refrigerator, the number of rotations of a compressor as a main noise source of the refrigerator may be varied such that a sound quality index related to an ambient noise during the operating of the refrigerator follows a sound quality index related to an ambient noise during the stopping of the refrigerator.

However, in this case, since a periodic noise variation according to various operation conditions such as starting of the compressor and driving of a refrigerating compartment and a freezing compartment is measured to calculate a sound quality index, a frequent noise variation for following the sound quality index may annoy a consumer.

In addition, since only the varying of the number of rotations of the compressor is insufficient to satisfy a sound quality index related to a noise varied according to operation states of the refrigerator, the number of rotations of the compressor may be excessively reduced to thereby degrade the performance of the compressor.

In addition, even when the number of rotations of the compressor is reduced based on a sound quality index to reduce a noise, the number of rotations of a refrigerator compartment fan and the number of rotations of a freezing compartment fan should be increased to prevent a performance degradation of the refrigerator, thereby further increasing a noise.

DISCLOSURE OF INVENTION

Technical Problem

Embodiments provide a method for controlling an operation of a refrigerator, in which the refrigerator is operated at a minimum noise level by varying freezing capacity of a compressor, and air volumes from fans in a refrigerating compartment, a freezing compartment, and a mechanical compartment, thereby satisfying consumers.

Solution to Problem

In one embodiment, a method for controlling an operation of a refrigerator including a reciprocating compressor, the method including: opening a refrigerator door; determining whether to perform a load mode according to whether the refrigerator door is opened or closed, and according to an inner temperature of the refrigerator; and determining whether to perform a stable mode or a silent mode according to a room temperature and an ambient noise, after the refrigerator door is closed.

The details of one or more embodiments are set forth in the accompanying drawings and the description below. Other features will be apparent from the description and drawings, and from the claims.

Advantageous Effects of Invention

According to the embodiments, the freezing capacity of the compressor, and air volumes from the fans in the refrigerating compartment and the mechanical compartment are varied in the silent mode such that an operation noise of the refrigerator is equal to or lower than the detection threshold with respect to an ambient noise, and thus, the ambient noise hides the operation noise of the refrigerator.

MODE FOR THE INVENTION

Reference will now be made in detail to the embodiments of the present disclosure, examples of which are illustrated in the accompanying drawings.

In a method for controlling an operation of a refrigerator, the refrigerator includes a linear compressor as a type of reciprocating compressor, but the present disclosure is not limited thereto.

Figure 1:
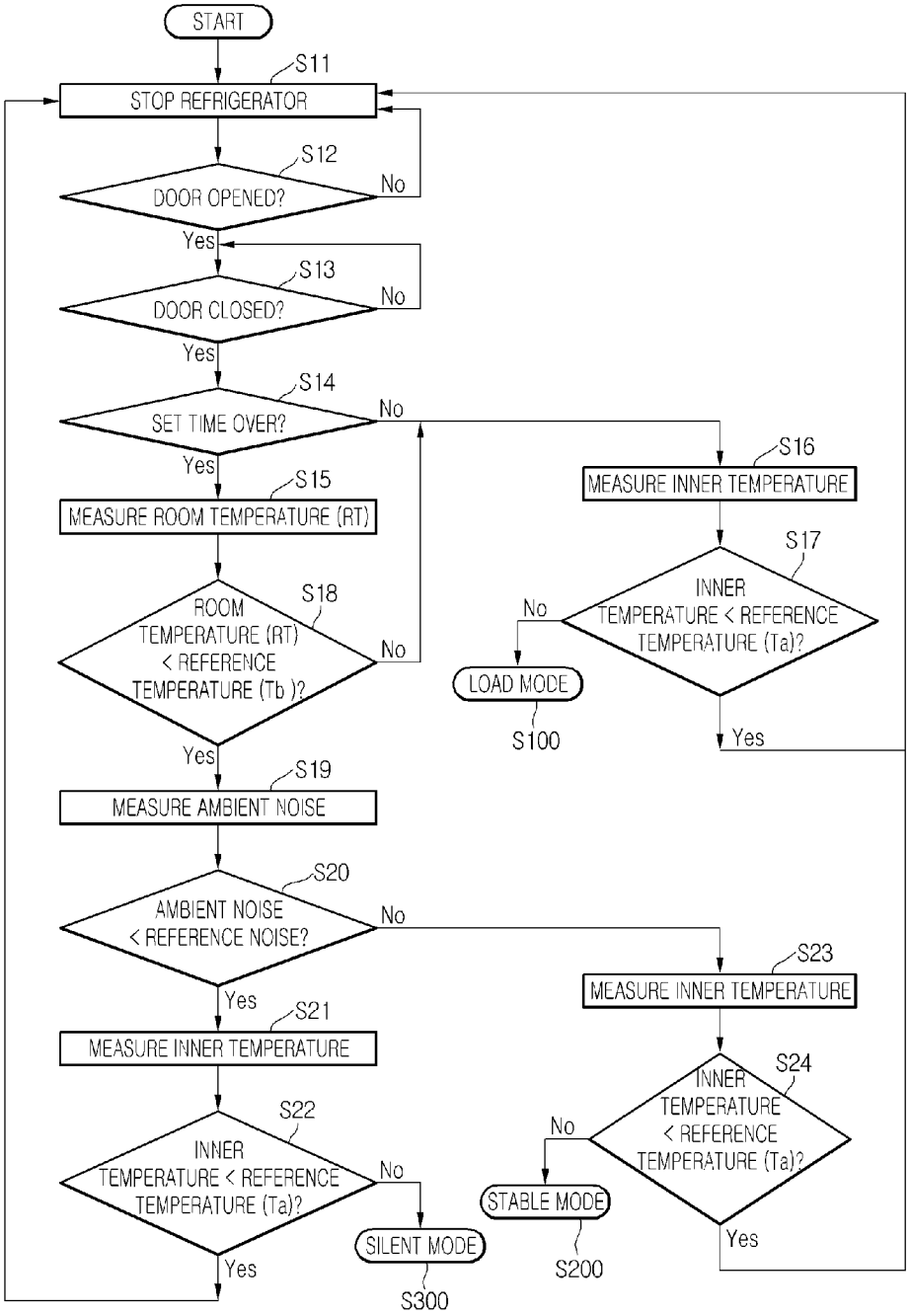
FIG. 1 is a flowchart illustrating a method for controlling an operation of a refrigerator according to an embodiment.

FIG. 1 is a flowchart illustrating a method for controlling an operation of a refrigerator according to an embodiment.

Referring to FIG. 1, in the method according to the current embodiment, the operation of the refrigerator is controlled at multiple stages according to opening/closing of a door of the refrigerator, heat load due to a room temperature, and an ambient noise. A linear compressor has a constant frequency regardless of operation modes, and a stroke of a piston and an air volume from a fan are varied. Accordingly, an operation noise from the refrigerator is maintained within a detection threshold of about 3 dB, so that a user cannot perceive the operation noise.

In detail, when the operation of the refrigerator is stopped in operation S11, it is sensed in operation S12 whether the door is opened. To this end, a door open sensor may be installed on a main body of the refrigerator. After that, it is sensed in operation S13 whether the door is closed.

After the door is closed, it is determined in operation S14 whether a set time is elapsed. An operation mode of the refrigerator is primarily determined according to whether the set time is elapsed. Operation modes of the refrigerator may be defined as operation modes of the compressor.

In more detail, after the door is closed, unless the set time is elapsed, the inner temperature of the refrigerator is measured in operation S16, and it is determined in operation S17 whether the inner temperature is less than a reference temperature Ta. If the inner temperature is less than the reference temperature Ta, the refrigerator is still stopped. On the contrary, if the inner temperature is equal to or greater than the reference temperature Ta, the refrigerator is operated since its inner load is high. That is, an operation mode corresponding to the inner load is performed in operation S100. The operation mode corresponding to the inner load is defined as a load mode. A method for controlling the load mode will be described later in detail with reference to the accompanying drawing.

After the door is closed, and the set time is elapsed, a room temperature RT is measured in operation S15. To this end, a temperature sensor may be installed on the outside of the refrigerator.

In detail, even after the door is closed, and the set time is elapsed, if the room temperature RT is equal to or higher than a reference temperature Tb, the possibility that heat is transferred into the refrigerator may be increased. Thus, in this case, the inner temperature of the refrigerator is measured in operation S16 to determine whether to perform operation S100.

On the contrary, if the room temperature RT is lower than the reference temperature Tb, the ambient noise is measured in operation S19, and an operation mode of the refrigerator is secondarily determined according to a value of the ambient noise.

In detail, after the door is closed, and the set time is elapsed, if the room temperature RT is lower than the reference temperature Tb, the ambient noise is measured. Then, it is determined whether a level (dB) of the ambient noise is less than a reference noise level (dB). If the level (dB) of the ambient noise is equal to or greater than the reference noise level (dB) in operation S20, the inner temperature of the refrigerator is measured in operation S23 to perform a stable mode. If the inner temperature is equal to or greater than the reference temperature Ta, the stable mode is performed in operation S200.

The level (dB) of the ambient noise may be equal to or greater than the reference noise level (dB) in the daytime when the room temperature RT may be lower than the reference temperature Tb, but the ambient noise may be relatively high. In the stable mode, the frequency of the compressor is maintained at a resonant frequency of a top dead center (TDC) operation, and the stroke of the compressor is smaller than in the load mode. In the stable mode, a refrigerating cycle may be driven according to a natural increase of the inner temperature of the refrigerator, without an external load increase factor such as opening of the door or inputting of a food. Accordingly, in the stable mode, the performance of the refrigerator is stably assured, and a noise from the compressor is reliably reduced. In other words, a noise from the compressor is acceptable.

In the stable mode, since a noise from the refrigerator is lower than the ambient noise, a user may not perceive a noise from the compressor. In detail, when a noise from the refrigerator is higher by about 10 dB or greater than the ambient noise, the ambient noise cannot hide the noise from the refrigerator. That is, a noise from the compressor hides the ambient noise.

If the level (dB) of the ambient noise is less than the reference noise level (dB) in operation S20, the inner temperature of the refrigerator is measured in operation S21, and an operation mode of the refrigerator is determined according to a value of the inner temperature.

In detail, if the inner temperature is less than the reference temperature Ta, it is unnecessary to supply cool air into the refrigerator, and thus, the refrigerator is still stopped. However, if the inner temperature is equal to or greater than the reference temperature Ta, a silent mode is performed in operation S300. The level (dB) of the ambient noise may be less than the reference noise level (dB) in the nighttime. In addition, the room temperature RT may be lower than the reference temperature Tb in the night time in winter.

In more detail, the ambient noise is relatively high at the night time in winter, and a frequency in use of the refrigerator is decreased. In this case, freezing capacity of the refrigerator may be reduced in the silent mode not to break a user's sleep. Since a frequency in use of the refrigerator is not high in the night time, although the freezing capacity thereof is reduced, there is no significant effect on a food in the refrigerator, and power consumption can be saved. In the silent mode, freezing capacity of the compressor is reduced when a load to the refrigerator is small in the night time or at a low room temperature such that an operation noise of the refrigerator is equal to or lower than the detection threshold of about 3 dB with respect to an ambient noise measured when the refrigerator is stopped. When a noise from the compressor is equal to or lower than the detection threshold, the ambient noise hides the operation noise of the refrigerator.

The method for controlling the load mode in operation S100 will now be described.

Figure 2:
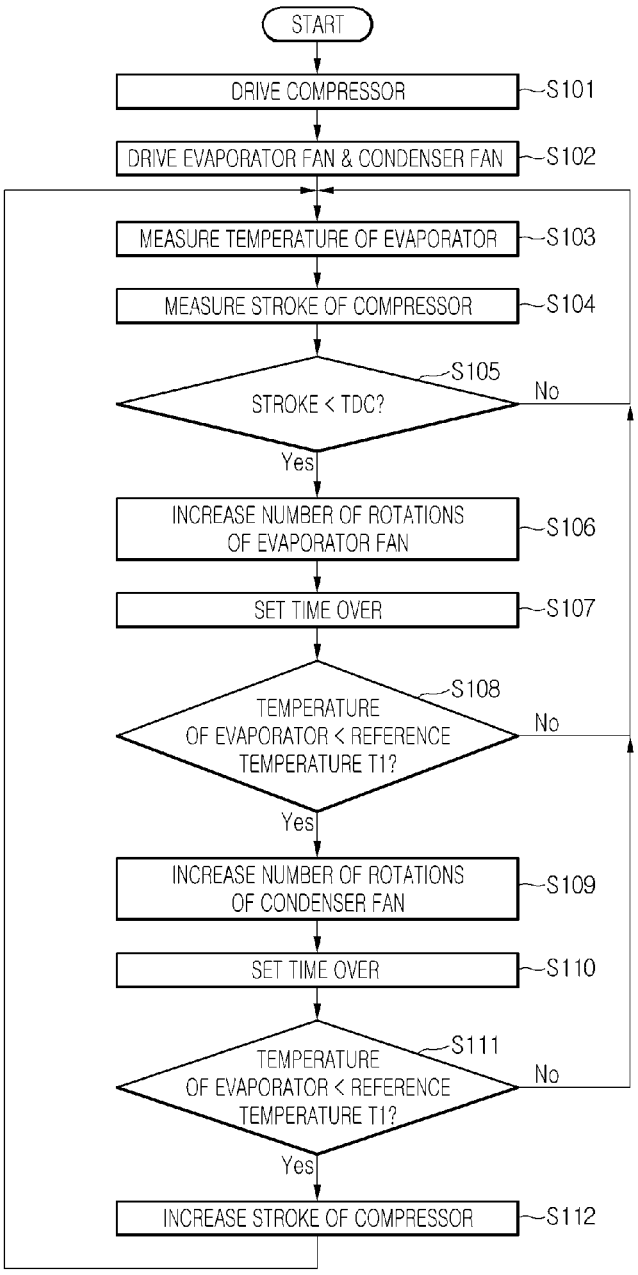
FIG. 2 is a flowchart illustrating a method for controlling a load mode in a method for controlling an operation of a refrigerator according to an embodiment.

FIG. 2 is a flowchart illustrating the method for controlling the load mode in the method for controlling the operation of the refrigerator.

As described above, the refrigerator is stopped, then, the door is opened and closed, then, a load to the refrigerator increases within the set time, and then, the inner temperature of the refrigerator is equal to or higher than the reference temperature Ta, and then, the load mode is performed Referring to FIG. 2, when the load mode is performed, the compressor is driven in operation S101. At this point, an evaporator fan and a condenser fan are driven in operation S102. In operation S103, a temperature of an evaporator is measured using a temperature sensor installed on the evaporator. A stroke of the compressor is measured in operation S104. At this point, the compressor is maintained at the resonant frequency. To this end, an operation frequency of the compressor is controlled to correspond to the resonant frequency. The resonant frequency is determined by Equation 1.

$$f - f_m = \frac{1}{2\pi} E \sqrt{\frac{k_m + k_g}{m}} \quad \text{Equation 1}$$

where $k_m$ denotes a modulus of elasticity of a mechanical spring supporting the piston in the compressor, $k_g$ denotes a modulus of elasticity of a gas spring, and m denotes the mass of both the piston and a member connected to the piston.

The reciprocating compressor, particularly, the linear compressor is controlled to adjust a flow rate of refrigerant according to required freezing capacity corresponding to a load. A flow rate of the compressor is determined by Equation 2.

$$Q - Cs(AsSsf) \quad \text{Equation 2}$$

where C denotes a proportional constant, A denotes a cross-sectional area, S denotes a stroke as a total linear distance travelled by the piston in one direction, and f denotes an operation frequency of the compressor.

Since the proportional constant C and the cross-sectional area A are constant, and the operation frequency f is fixed to the resonant frequency, the flow rate of the compressor is determined by the stroke S.

Thus, since the stroke S is adjusted according to a required freezing capacity of the compressor, it is necessary to measure the stroke S in real time while the compressor is driven. The operation frequency f and the stroke S increase from a small load condition to a large load condition, and the operation frequency f is controlled to follow the resonant frequency. The maximum freezing capacity of the compressor corresponds to a flow rate of the refrigerant when the compressor is in the TDC operation. The stroke S is maximum in the TDC operation in which a head surface of the piston reciprocates between the TDC and a bottom dead center (BDC). That is, a head of the piston moves up to the TDC.

It is determined whether the stroke S is smaller than that in the TDC operation in operation S105. Unless the stroke S is smaller than that in the TDC operation, the stroke S, the number of rotations of the evaporator fan, and the number of rotations of the condenser fan are not varied. On the contrary, if the stroke S is smaller than that in the TDC operation, the number of rotations of the evaporator fan is increased in operation S106. Since the inner temperature of the refrigerator is high in the load mode, cool air should be supplied to the refrigerator. Thus, in the case, when the compressor is not in the TDC operation, the number of rotations of the evaporator fan is increased.

After the number of rotations of the evaporator fan is increased, and a set time is elapsed in operation S107, it is determined in operation S108 whether a temperature of the evaporator is lower than a reference temperature T1. If the temperature of the evaporator is equal to or greater than the reference temperature T1, there is no change in the refrigerator. If the temperature of the evaporator is still lower than the reference temperature T1, the number of rotations of the condenser fan is increased in operation S109. When the number of rotations of the condenser fan is increased to maximally change the refrigerant to a saturated liquid state through phase transformation, a temperature at an inlet of the evaporator is decreased to improve a heat exchange with cool air in the refrigerator. Accordingly, a load in the refrigerator can be quickly reduced.

After the number of rotations of the condenser fan is increased, and a set time is elapsed in operation S110, it is determined in operation S111 whether a temperature of the evaporator is lower than the reference temperature T1. If the temperature of the evaporator is lower than the reference temperature T1, the stroke S is increased in operation S112. Accordingly, the freezing capacity of the compressor is increased, thereby more quickly decreasing the inner temperature of the refrigerator.

As such, the number of rotations of the evaporator fan and the number of rotations of the condenser fan are appropriately adjusted according to a temperature of the evaporator in the load mode, thereby decreasing the inner temperature of the refrigerator. The stroke S is increased in phases according to loads in the refrigerator until the compressor reaches the TDC operation, thereby increasing the freezing capacity of the compressor. At this point, when the inner temperature of the refrigerator reaches the reference temperature Ta, the refrigerator is stopped.

Figure 3:
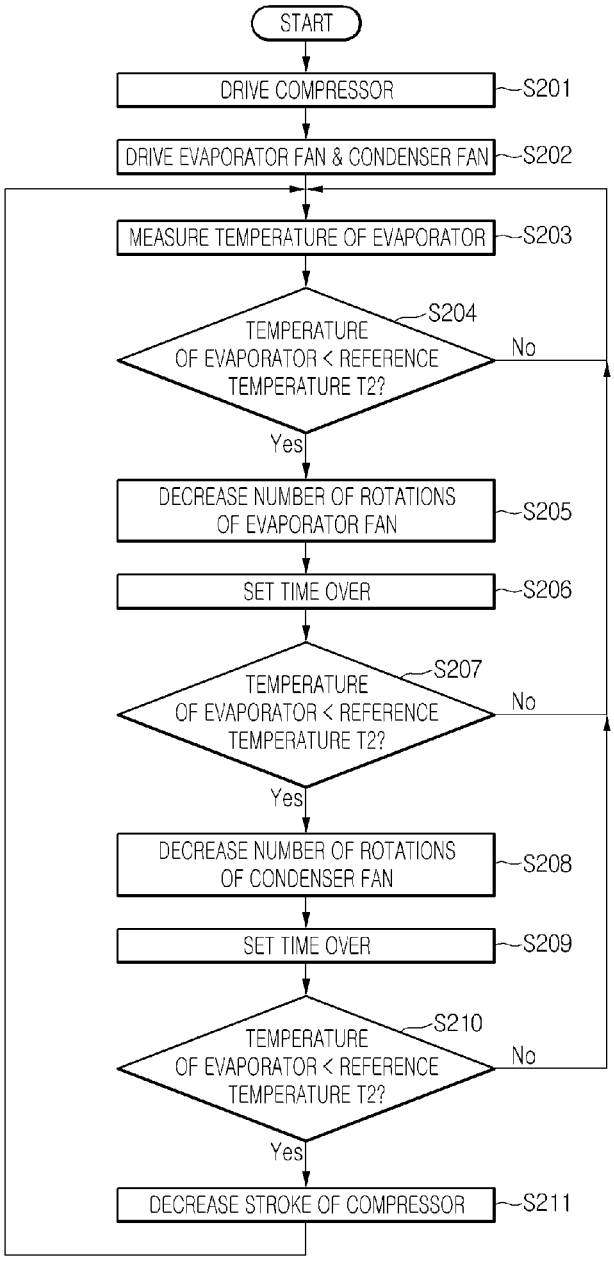
FIG. 3 is a flowchart illustrating a method for controlling a silent mode in a method for controlling an operation of a refrigerator according to an embodiment.

FIG. 3 is a flowchart illustrating a method for controlling the silent mode in the method for controlling the operation of the refrigerator.

The method for controlling the silent mode is the same as a method for controlling the stable mode, except for a reference temperature of the evaporator as a parameter for determining both the number of rotations of the evaporator fan and the number of rotations of the condenser fan. That is, a reference temperature T2 of the evaporator in the silent mode for determining whether to vary both the number of rotations of the evaporator fan and the number of rotations of the condenser fan is lower than a reference temperature T3 of the evaporator in the stable mode. The reference temperature T1 of the evaporator in the load mode is higher than the reference temperature T2 of the evaporator in the silent mode. That is, a relationship of T1>T3>T2 is formed.

Since the method for controlling the silent mode is the same as the method for controlling the stable mode, except for a reference temperature of the evaporator, a description of the method for controlling the stable mode will be omitted.

Referring to FIG. 3, when the silent mode is performed, the compressor is driven in operation S201. At this point, the evaporator fan and the condenser fan are driven in operation S202. In operation S203, a temperature of the evaporator is measured. In operation S204, it is determined whether the temperature of the evaporator is lower than the reference temperature T2. Operations S201, S202, S203, and S204 are the same as those in the load mode except that the reference temperature T2 is lower than the reference temperature T1 of the load mode.

In detail, if the temperature of the evaporator is lower than the reference temperature T2, the number of rotations of the evaporator fan is reduced in operation S205. This is different from the method for controlling the load mode in which the number of rotations of the evaporator fan is increased. The silent mode is performed in the night time when a room temperature, the ambient noise, and a frequency in use of the refrigerator are low. Substantially, there is no quick change in load to the refrigerator, and thus, the number of rotations of the evaporator fan may be decreased to reduce a noise.

After the number of rotations of the evaporator fan is decreased, and a set time is elapsed in operation S206, it is determined in operation S207 whether the temperature of the evaporator is lower than the reference temperature T2. If the temperature of the evaporator is lower than the reference temperature T2, the number of rotations of the condenser fan is also decreased in operation S208. This is because of the same reason as in the previous one that the number of rotations of the evaporator fan is decreased.

After the number of rotations of the condenser fan is decreased, and a set time is elapsed in operation S209, it is determined in operation S210 whether the temperature of the evaporator is lower than the reference temperature T2. If the temperature of the evaporator is lower than the reference temperature T2, the stroke S is decreased. Since the temperature of the evaporator is lower than the reference temperature T2 even after the number of rotations of the evaporator fan and the number of rotations of the condenser fan are decreased to reduce an operation performance of the refrigerator means, a variation in load to the refrigerator is considered to be small. That is, the freezing capacity of the compressor can be further decreased, and thus, the stroke S is reduced to improve a noise reduction performance.

As described above, the freezing capacity of the compressor, the number of rotations of the evaporator fan, and the number of rotations of the condenser fan are varied in conjunction with one another according to temperatures of the evaporator, thereby ensuring the performance of the refrigerator and reducing a noise from the refrigerator.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A method for controlling an operation of a refrigerator including a reciprocating compressor, a condenser, an evaporator, a condenser fan, and an evaporator fan, the method comprising:

measuring a room temperature when a refrigerator door is determined to be closed after the refrigerator door is opened, wherein the room temperature is measured after a first preset time has elapsed;

measuring an ambient noise when the room temperature is determined to be lower than a first reference temperature; and measuring an inner temperature which is defined as a temperature in a storage compartment of the refrigerator when the ambient noise is lower than a reference noise, wherein detecting the opening/closing of the refrigerator door, the measuring the room temperature for determining of heat load transmission in the refrigerator, and the measuring the inner temperature are successively performed, in order to control the operation of the refrigerator at multi stages, wherein a silent mode is performed when the first preset time has lapsed after closing the refrigerator door, the room temperature is lower than the first reference temperature, the ambient noise is lower than the reference noise, and the inner temperature is greater than a second reference temperature, wherein the silent mode includes:

driving the compressor, the evaporator fan, and the condenser fan; and measuring a temperature of the evaporator, wherein a number of rotations of the evaporator fan is firstly varied according to the temperature of the evaporator, a number of rotations of the condenser fan is secondly varied, and a stroke of the compressor is thirdly varied, according to the temperature of the evaporator.

2. The method of claim 1, wherein the number of rotations of the evaporator fan is controlled to be decreased when the temperature of the evaporator is lower than a third reference temperature.

3. The method of claim 2, wherein the number of rotations of the condenser fan is controlled to be decreased when the temperature of the evaporator is still lower than the third reference temperature after the number of rotations of the evaporator fan has been decreased.

4. The method of claim 3, wherein the stroke of the compressor is controlled to be decreased when the temperature of the evaporator is still lower than the third reference temperature after the number of rotations of the condenser fan has been decreased.

5. The method of claim 1, wherein the reciprocating compressor comprises a linear compressor.

* * * * *